US007950355B2

(12) United States Patent
Nakamizo

(10) Patent No.: US 7,950,355 B2
(45) Date of Patent: May 31, 2011

(54) AIR-COOLED ENGINE HAVING IMPROVED DUST PREVENTIVE STRUCTURE

(75) Inventor: Keiichi Nakamizo, Maryville, MO (US)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 332 days.

(21) Appl. No.: 12/130,153

(22) Filed: May 30, 2008

(65) Prior Publication Data

US 2009/0293835 A1 Dec. 3, 2009

(51) Int. Cl.
*F01P 7/04* (2006.01)

(52) U.S. Cl. ..... 123/41.67

(58) Field of Classification Search ..... 123/184.21, 123/195 P, 198 E, 198 R, 196 W, 41.65, 41.7; 440/77, 76, 88, 88 A, 61 T, 49, 88 R; 277/637, 277/641; 164/271; 403/258; 74/595; 116/202
See application file for complete search history.

(56) References Cited

U.S. PATENT DOCUMENTS 5,445,547 A * 8/1995 Furukawa ..... 440/77
6,964,255 B2 * 11/2005 Shomura et al. ..... 123/198 E

FOREIGN PATENT DOCUMENTS

JP 60-21466 6/1985
JP 2513184 7/1996

* cited by examiner

*Primary Examiner* — Michael Cuff
*Assistant Examiner* — Keith Coleman

(57) ABSTRACT

An air-cooled engine is provided, in which a cooling fan assembly for inducing a stream of cooling air and a screen member for covering an axial end face of the cooling fan on a suction side are drivingly mounted on a rotary drive shaft of the engine. A fan casing covering the cooling fan assembly and defining an air flow path for the flow of the stream of cooling air is formed with an air intake opening through which the cooling air is introduced towards the cooling fan assembly and the screen member. A cutter is formed in an outer peripheral portion of the screen member or its neighbor so as to protrude axially close to an inner surface of the fan casing at a position downstream of the cooling air from the air intake opening.

14 Claims, 8 Drawing Sheets

AIR-COOLED ENGINE HAVING IMPROVED DUST PREVENTIVE STRUCTURE

BACKGROUND OF THE INVENTION

1. Field of the Invention

The present invention relates to an improvement of a dust preventive structure employed in an air-cooled engine that is mounted mainly on a work machine such as, for example, a brush cutting machine as a drive source.

2. Description of the Prior Art

In general, an air-cooled engine has hitherto been employed as a drive source for a work machine such as, for example, a brush cutting machine. As best shown in FIG. 12, this known air-cooled engine is in the form of, for example, an vertical combustion engine having a rotary drive shaft 61 of the engine E1 oriented vertically and generally includes, in addition to the rotary drive shaft 61, a cooling fan assembly 62 drivingly coupled with the rotary drive shaft 61 and concurrently serving as a flywheel, and a fan casing 63 having an air intake opening 64 defined therein and so designed as to guide a stream of cooling air A1, induced by the cooling fan assembly 62, towards the air-cooled engine E1.

In this known brush cutting machine employing the air-cooled engine, in order to prevent dusts such as, for example, chips of turf and/or grass cut by the brush cutting machine, from intruding in admixture with the stream of cooling air A1, a dust preventive screen member 65 is disposed in the air intake opening 64 in the fan casing 63 and fitted to a recoil engagement 66 that is secured to the rotary drive shaft 61. This dust preventive screen member 65 has an outer peripheral portion formed with a cutter 67. The cutter 67 extends radially outwardly therefrom over the air intake opening 64 in the fan casing 63 and terminates in the vicinity of an outer peripheral surface 68*a* of a flange 68 defining an outer edge of the air intake opening 64. A recoil casing 69 concurrently serving as a covering is utilized to cover an outer area of the air intake opening 64 in the fan casing 63.

According to the Japanese Utility Model Registration No. 2513184, the brush cutting machine of the structure described above is so designed and so operable that long turf and/or grass 70 sucked by the cooling fan assembly 62 move radially outwardly of the screen member 65 by the effect of a centrifugal force developed by rotation of the screen member 65 and are, after having been cut by the cutter 67, discharged to the outside of the fan casing 63 by the effect of the centrifugal force.

The Japanese Utility Model Examined Publication No. 60-21466, published Jun. 26, 1985, discloses a similar brush cutting machine, but designed to have a structure for sucking chips of turf and/or grass after long turf and/or grass have been cut to the chips.

It has however been found that since the cutter 67 integral with the screen member 65 referred to above is positioned in the vicinity of the outer peripheral surface 68*a* of the flange 68 forming the air intake opening 64 in the fan casing 63, an overhang OH, i.e., the distance measured in a radial direction from a point of support of the screen member 65 to the outer peripheral edge of the screen member 65 where the cutter 67 is formed, tends to be large. For this reason, in mounting the screen member 65 which rotates together with the cooling fan assembly 62, the screen member 65 must be supported by a support structure of a design effective to secure a sufficient mounting rigidity and, accordingly, the freedom of design tends to be lowered.

Also, where the covering member is provided integrally with the fan casing 63 at the air intake opening 64, the screen member 65 in its entirety must be inserted into the fan casing 63. Accordingly, it is impossible to employ the structure, in which the cutter 67 integral with the screen member 65 is positioned in the vicinity of the outer peripheral surface 68*a* of the flange 68 forming the air intake opening 64.

SUMMARY OF THE INVENTION

In view of the foregoing, an object of the present invention is to provide an air-cooled engine, in which the screen member having the cutter is mounted with the radial overhang minimized to increase the freedom of design and in which turf and/or grass can be effectively cut with the cutter.

In order to accomplish the foregoing object, the present invention according to a first aspect thereof provides an air-cooled engine including a rotary drive shaft, a cooling fan assembly drivingly coupled with the rotary drive shaft for inducing a stream of cooling air, a screen member drivingly coupled with the rotary drive shaft so as to cover an axial end face of the cooling fan assembly on a suction side, and a fan casing covering the cooling fan assembly and defining a path of flow of the stream of cooling air. The fan casing has an air intake opening defined therein for introducing the stream of cooling air to the cooling fan assembly and the screen member. A cutter is formed in an outer peripheral portion of the screen member or its neighbor so as to protrude axially close to an inner surface of the fan casing at a position downstream of the cooling air from the air intake opening.

According to the present invention, the cutter in the screen member protrudes axially outwardly and terminates in the vicinity of the inner surface of the fan casing. In other words, the entirety of the screen member including the cutter in the vicinity of the fan casing is accommodated inside the fan casing. Accordingly, a portion of the screen member adjacent the outer periphery thereof can be supported by the cooling fan assembly and, hence, a relatively large overhang occurring in a radial direction of the screen member, when the cutter in the screen member is arranged outside the air intake opening of the fan casing, can be eliminated.

Also, since, as a result of the screen member being accommodated within the fan casing together with the cooling fan assembly, the outer peripheral portion of the screen member can be so designed and so configured as to be positioned in engagement with or in the vicinity of the cooling fan assembly to thereby suppress a relatively large deformation of the outer peripheral portion, the screen member need not use any complicated support structure, allowing the freedom of design to be enhanced. Also, since the cutter in the screen member protrudes axially outwardly and terminates in the vicinity of the inner surface of the fan casing, relatively long turfs and/or grasses transported radially outwardly of the screen member by the effect of the stream of cooling air and the centrifugal force developed by rotation of the screen member can be deflected axially outwardly so that they can be effectively cut finely by the cutter at a location between the screen member and the fan casing. Therefore, even though the finely divided turns and/or grasses are transported towards the cylinder blocks and the cylinder heads by the stream of cooling air, clogging of those divided turfs and/or grasses at a location where they have been so transported can be avoided.

In a preferred embodiment of the present invention, the screen member referred to above may have an annular recess defined in a portion of the screen member radially inwardly of the cutter so as to be recessed in a direction away from the fan casing. Considering that the relatively long turfs and/or grasses, which have been transported by the stream of cooling air and the centrifugal force, are trapped in the annular recess, shortly before they reach the cutter, and are then retarded in transporting speed so that after they have been deflected in an axial direction along the cutter they can be guided in between the cutter and the fan casing. Accordingly, rough cutting of the turfs and/or grasses, which would otherwise occur as they pass at a high speed through a gap between the cutter and the fan casing, can be effectively suppressed.

In another preferred embodiment of the present invention, the fan casing may be formed with an annular lug protruding in a direction away from the fan casing and towards a portion of the screen member radially inwardly of the cutter. This is particularly advantageous in that since the relatively long turfs and/or grasses transported radially outwardly by the stream of cooling air and the centrifugal force can be deflected in contact with the annular lug so as to direct axially inwardly and subsequently deflected within the annular recess so as to direct axially outwardly to enter the gap between the cutter and the fan casing, the turfs and/or grasses can be further finely cut by the cutter.

In a further preferred embodiment of the present invention, the cutter may include a plurality of cutting blades arranged in a direction circumferentially of the screen member and protruding in a direction close to the fan casing. The relatively long turfs and/or grasses can be quickly and finely cut by the plural cutting blade.

In a still further preferred embodiment of the present invention, each of the cutting blades may have a leading edge, with respect to a direction of rotation of the cutter, extending from a root portion to a tip in an axially outward direction and gradually curved rearwardly with respect to the direction of rotation. This is particularly advantageous in that since during the rotation of the cutter, cutting forces of the cutting blades are gradually applied to the turfs and/or grasses progressively from the root portion to the tip of the leading edges, the turfs and/or grasses can be cut assuredly. Further, since no large cutting load acts instantly on the cutting blades, the intended durability of the cutting blades can be secured.

In a still further preferred embodiment of the present invention, the fan casing may include a cover member for covering the air intake opening and allowing the stream of cooling air to pass therethrough. The use of the cover member is effective not only to avoid an exposure of the rotating screen member to the outside, but also to prevent the relatively large dust containing turfs and/or grasses from entering into the fan casing through the air intake opening. Also, since the cutter in the screen member is arranged inside the fan casing, the fan casing can be integrally formed with the cover member, allowing the number of component parts used and the number of assembling steps, and thereby achieving the cost reduction.

In a still further preferred embodiment of the present invention, the screen member may be fitted to, for example, a plurality of support posts protruding from the cooling fan assembly in an axial direction. According to this feature, since the radial overhang of the screen member extends from the support posts to the outer periphery of the screen member, the overhang can be minimized to increase the rigidity of the screen member when the support posts are suitably arranged at respective locations radially outwardly of the screen member. In addition, by forming the support post in a slender configuration, the possibility of the support posts disturbing the suction of the stream of cooling air can be suppressed as much as possible to allow a sufficient amount of the cooling air to be secured.

The present invention in accordance with a second aspect thereof provides an air-cooled engine, which is similar in structure to that designed in accordance with the first aspect of the present invention, but in which instead of the cutter formed in the screen member and protruding axially outwardly therefrom, the cutter is formed in the outer peripheral portion of the screen member so as to protrude radially outwardly to terminate in the vicinity of the inner surface of the fan casing.

According to the second aspect of the present invention, as is the case with the air-cooled engine constructed in accordance with the first aspect of the present invention, the relatively large overhang of the screen member in the radial direction can be resolved and, at the same time, there is no need to employ any complicated support structure for the screen member, allowing the freedom of design to be enhanced. Also, since the outer peripheral portion of the screen member is formed with the cutter protruding radially outwardly and terminating in the vicinity of the inner surface of the fan casing, the relatively long turfs and/or grasses transported towards the outer peripheral portion of the screen member by means of the stream of cooling air and the centrifugal force can be effectively and finely cut by the cutter at a location between the screen member and the fan casing. Therefore, even though the finely divided turns and/or grasses are transported towards the cylinder blocks and the cylinder heads by the stream of cooling air, no clogging of those divided turfs and/or grasses occurs at a location where they have been so transported.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, some preferred embodiments of the present invention will be described in detail with reference to the accompanying drawings.

Figure 1:
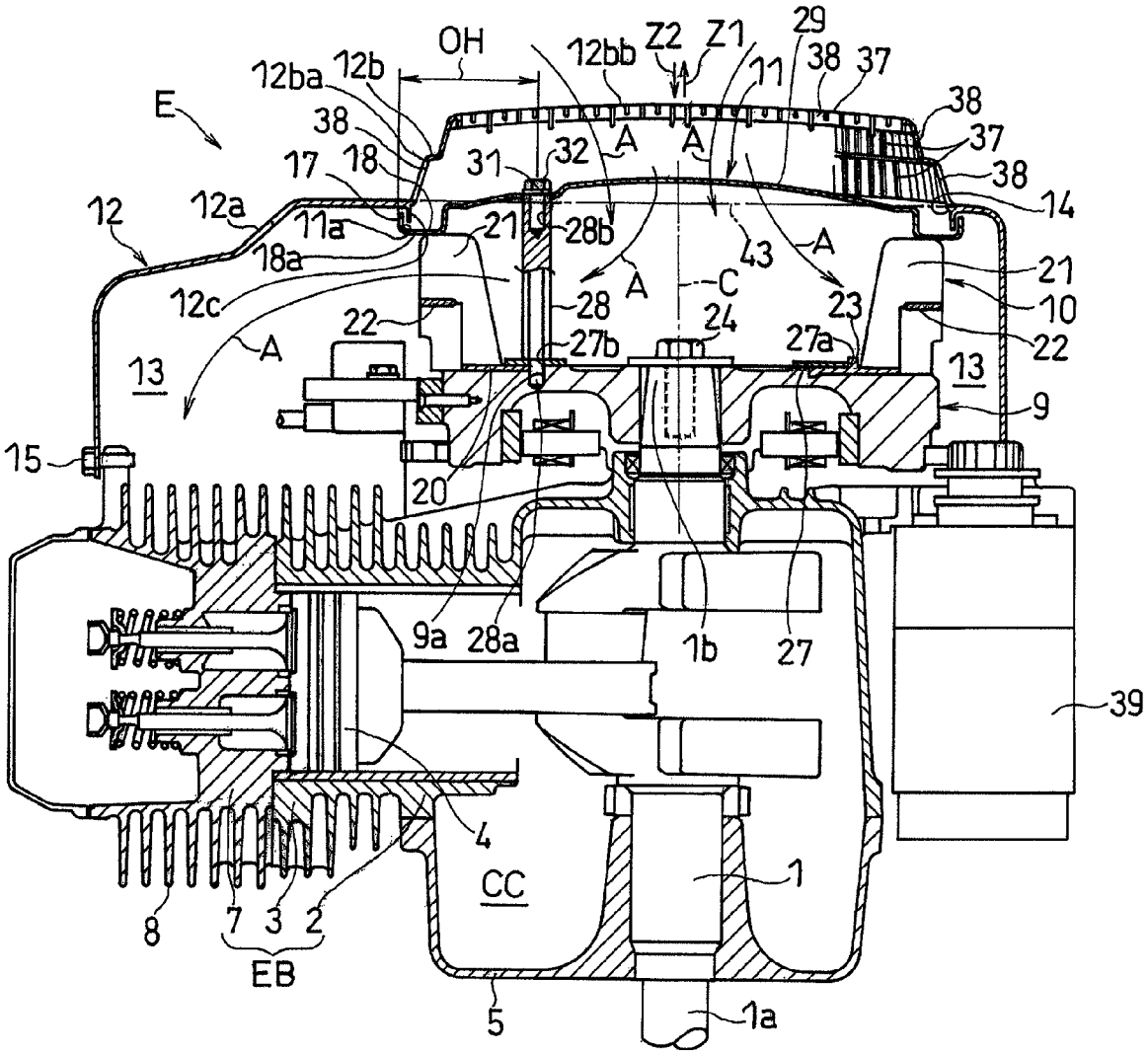
FIG. 1 is a longitudinal sectional view showing an air-cooled engine according to a first preferred embodiment of the present invention.

FIG. 1 illustrates a longitudinal sectional view showing an air-cooled engine E according to a first preferred embodiment of the present invention. The illustrated air-cooled engine E is of a V-shaped two-cylinder vertical type and includes a crankshaft 1, which is a rotary drive shaft, a crankcase 2 and an oil pan 5 secured to a bottom of the crankcase 2 to thereby define a cranking chamber cc therebetween. The crankshaft 1 extends vertically across the cranking chamber cc with its opposite, lower and upper ends 1*a* and 1*b* protruding outwardly from the oil pan 5 and the crankcase 2, respectively. The crankcase 2 is formed integrally with a cylinder blocks 3 each having a cylinder bore defined therein, and a reciprocating piston 4 movable reciprocatingly within the cylinder bore in the respective cylinder block 3 in a direction substantially perpendicular to the longitudinal sense of the crankshaft 1 is drivingly coupled with a generally intermediate portion of the crankshaft 1. The cylinder blocks 3 may be formed separately from the crankcase 2 and secured to the crankcase 2. The cylinder blocks 3 have a multiplicity of cooling fins 8 and one end of each of the cylinder blocks 3 remote from the crankshaft 1 is closed by a cylinder head 7 also having cooling fins 8 formed integrally therewith.

The crankcase 2, the cylinder blocks 3, the oil pan 5, the cylinder head 7 and others form a main engine body EB. A fan casing 12 is mounted atop the main engine body EB. The lower end 1*a* of the crankshaft 1 protruding downwardly from the crankcase 2 through the oil pan 5 is utilized as a drive output shaft and, where the air-cooled engine E embodying the present invention is to be mounted on, for example, a brush cutting machine that is a sort of the work machine, a cutter blade assembly is mounted on the lower end 1*a* of the crankshaft 1 for rotation together therewith.

Figure 2:
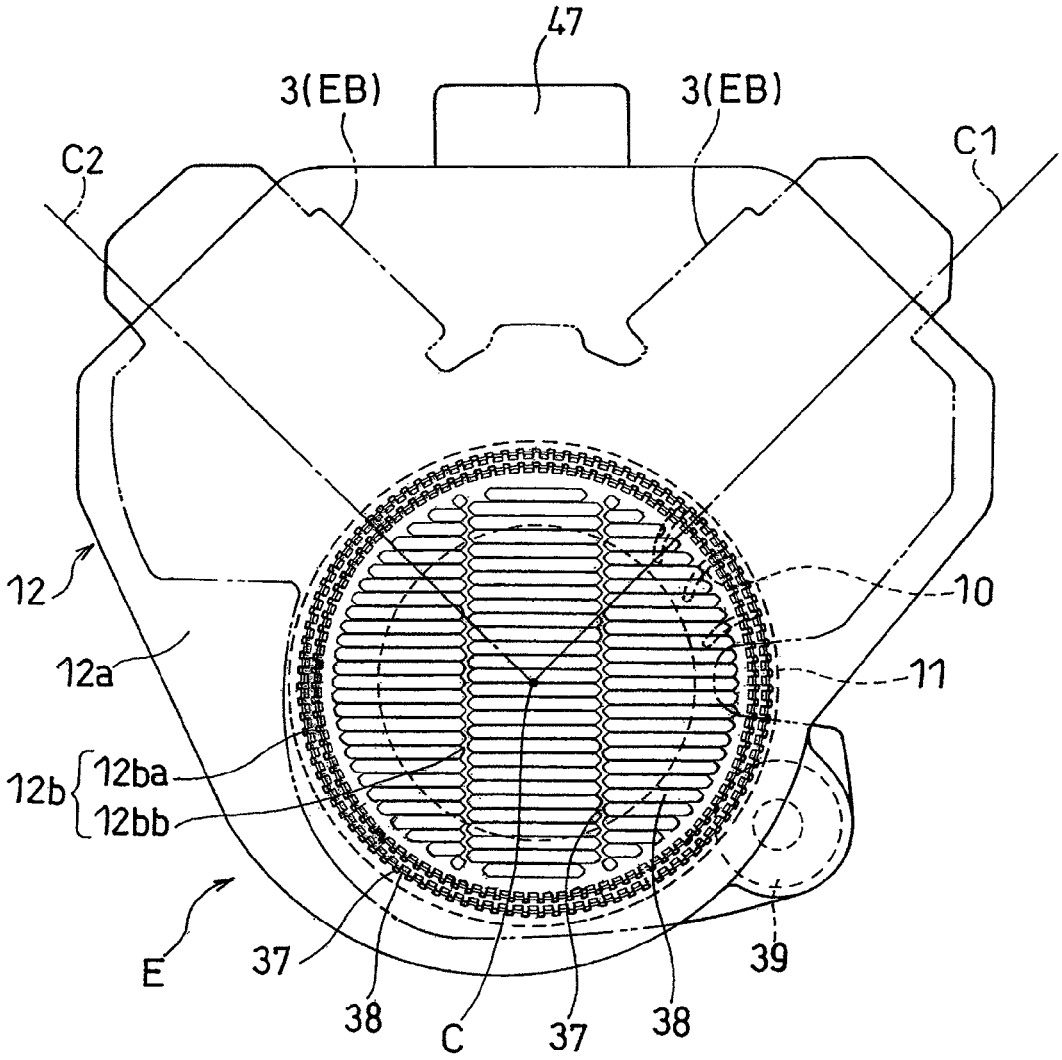
FIG. 2 is a schematic top plan view of the air-cooled engine shown in FIG. 1.

As shown in a top plan view in FIG. 2, the main engine body EB has two cylinder axes C1 and C2 that extend in alignment with respective longitudinal axes of the cylinder blocks 3 and are laid in V-shaped formation while spaced substantially 90° relative to each other about the longitudinal axis C of the crankshaft 1. The air-cooled engine E embodying the present invention can be started by means of an electrically driven starter motor 39 in any known manner. Although not shown, an air cleaner and others are arranged in a space delimited between the cylinder blocks 3 and 3 having respective axes C1 and C2 together with a carburetor 47.

As shown in FIG. 1, a flywheel 9 including a permanent magnet forming a part of an engine ignition system is mounted on the upper end 1*b* of the crankshaft 1, which protrudes upwardly from the crankcase 2, so as to rotate together with the crankshaft 1. This flywheel 9 is provided with a cooling fan assembly 10 for rotation together therewith to induce a stream of cooling air A. A dust preventive screen member 11 is fitted to the cooling fan assembly 10 by means of a plurality of support posts 28 so as to cover a suction side (an upper region of the drawing of FIG. 1), which is a region axially outside of the cooling fan assembly 10, i.e., for covering an upstream area above the cooling fan assembly 10 with respect to the direction of flow of the stream of cooling air A. Each of the support posts 28 is in the form of a hexagonal stud bolt extending upwardly from the flywheel 9 through the cooling fan assembly 10 in an axial direction substantially parallel to the crankshaft 1. In the illustrated embodiment, three equally spaced support posts 28 are employed, but the number of the support posts 28 that can be employed in the practice of the present invention is not always limited to three such as shown, but may be two or more than three. The details of the manner of supporting each of the flywheel 9, the cooling fan assembly 10 and the screen member 1 will be described later.

The fan casing 12 is made of a resinous material and includes a main casing body 12*a* covering the cooling fan assembly 10, a cover member 12*b* positioned above the screen member 11 so as to overhang an axially outer region of the latter, and an annular lug 12*c* protruding inwardly towards an inner surface thereof. The main casing body 12*a* is supported by the main engine body EB by means of a plurality of bolts 15 so as to define a cooling air flow path 13 through which the stream of cooling air A induced by the cooling fan assembly 10 can be introduced to the cylinder blocks 3, the cooling fins 8 of the cylinder heads 7 and the crankcase 2. In this way, the cooling fan assembly 10 and the screen member 11 in their entirety are accommodated within the fan casing 12.

The main casing body 12*a* has an air intake opening 14 defined therein for introducing the stream of cooling air A therethrough towards the cooling fan assembly 10 and the screen member 11. The cover member 12*b* is formed integrally with the main casing body 12*a* so as to cover the air intake opening 14. This cover member 12*b* includes a peripheral wall 12*ba* and a top wall 12*bb*, both of which are formed with a multiplicity of air flow slits 38 defined by a number of grids 37 so that an outside air can be sucked therethrough into the fan casing 12 in the form of the stream of air A during the rotation of the cooling fan assembly 10.

The screen member 11 has an outer peripheral portion formed with a cutter 17 which protrudes outwardly in an axial direction Z1 (upwardly as viewed in FIG. 1) that is parallel to the longitudinal axis of the crankshaft 1 of the air-cooled engine E and terminates in the vicinity of an inner surface of the fan casing 12. The screen member 11 has an annular recess 18 formed therewith at a location radially inwardly of the cutter 17 and recessed inwardly in an axial direction Z2 (downwardly as viewed in FIG. 1) away from the fan casing 12 and parallel to the longitudinal axis of the crankshaft 1. In the illustrated embodiment, the cutter 17 forms an outer peripheral wall of the annular recess 18. The annular lug 12*c* referred to previously is formed integrally with the fan casing 12 and positioned in the vicinity of the air intake opening 14 so as to protrude into the annular recess 18, terminating in the vicinity of a portion 11*a* of the screen member 11 which portion 11*a* confronts radially inwardly of the cutter 17.

Figure 3:
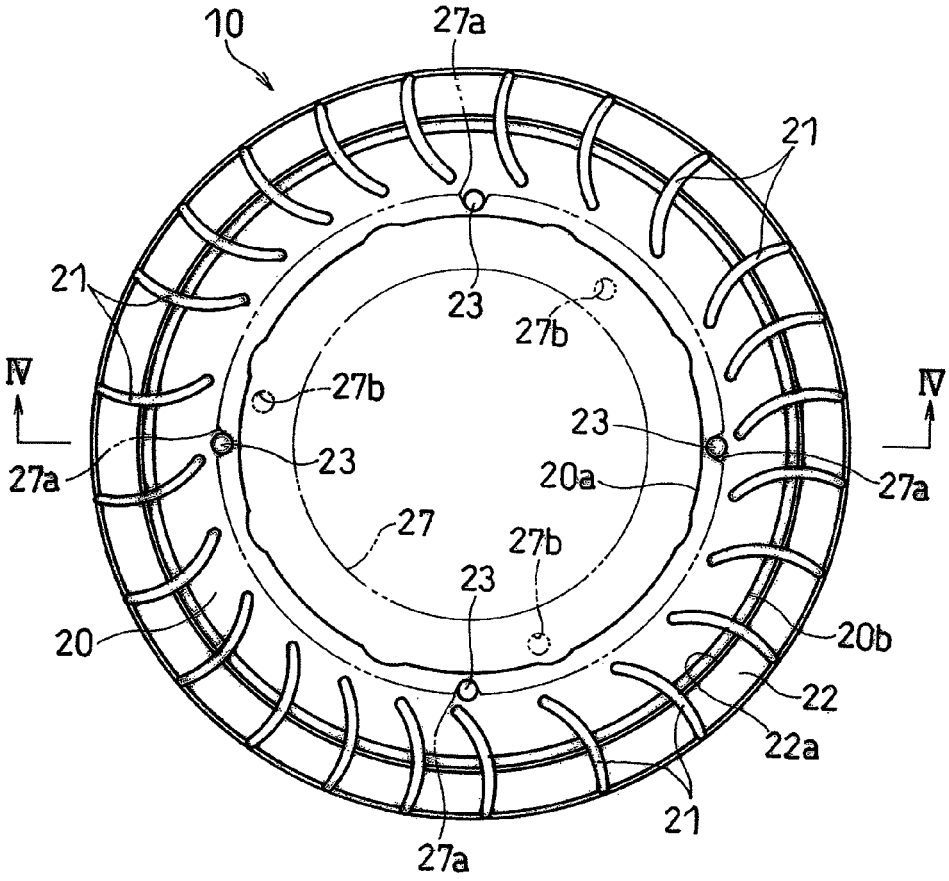
FIG. 3 is a top plan view showing a cooling fan assembly employed in the air-cooled engine.
Figure 4:
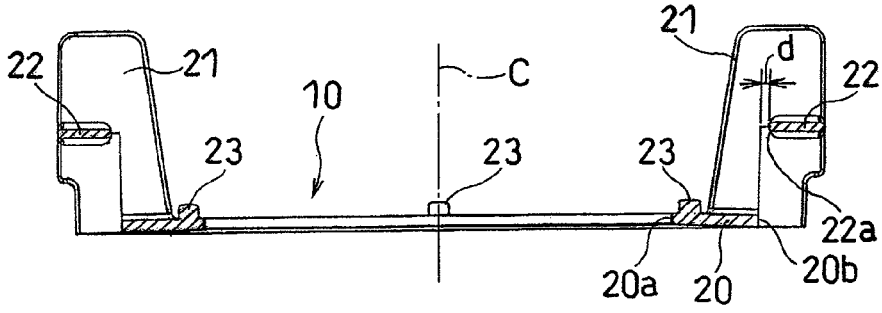
FIG. 4 is a cross-sectional view taken along the line IV-IV in FIG. 3.

FIG. 3 illustrates the cooling fan assembly 10 in a top plan view and FIG. 4 illustrates a cross-sectional view taken along the line IV-IV in FIG. 3. As best shown in FIG. 3, the cooling fan assembly 10 is of single-piece construction made of a synthetic resin such as, for example, polypropylene or metal by the use of any known molding technique and includes an annular base plate 20, a plurality of rotary blades 21 of a curved plate-like configuration upstanding from the annular base plate 20 and spaced an equal distance from each other in a direction circumferentially of the annular base plate 20, and intermediate connecting plates 22 each connecting between the neighboring rotary blades 21.

As best shown in FIG. 4, each of the intermediate connecting plates 22 has its opposite ends connected to axially intermediate portions of the neighboring rotary blades 21, respectively, so that any undesirable deformation of the rotary blades 21 can be suppressed which would otherwise occur under the influence of a centrifugal force developed during the rotation of the cooling fan assembly 10. A plurality of knock pins 23 are formed in the annular base plate 20 so as to extend upwards in the vicinity of an inner peripheral edge 20*a* thereof as shown in FIG. 3.

Also as best shown in FIG. 4, the intermediate connecting plates 22 are so secured to the rotary blades 21 of the cooling fan assembly 20 and so positioned that a radial inner edge 22*a* of each of the intermediate connecting plates 22 can occupy a position spaced a predetermined distance d radially outwardly from an outer peripheral edge 20*b* of the annular base plate 20. Accordingly, when viewed in a direction aligned with the longitudinal axis C of the crankshaft 1, the annular base plate 20 and the intermediate connecting plates 22 do not overlap one above the other. Therefore, the cooling fan assembly 10 of the structure described above can be formed by any known molding technique using a simplified mold assembly comprised of two vertically separable mold pieces.

Figure 5A:
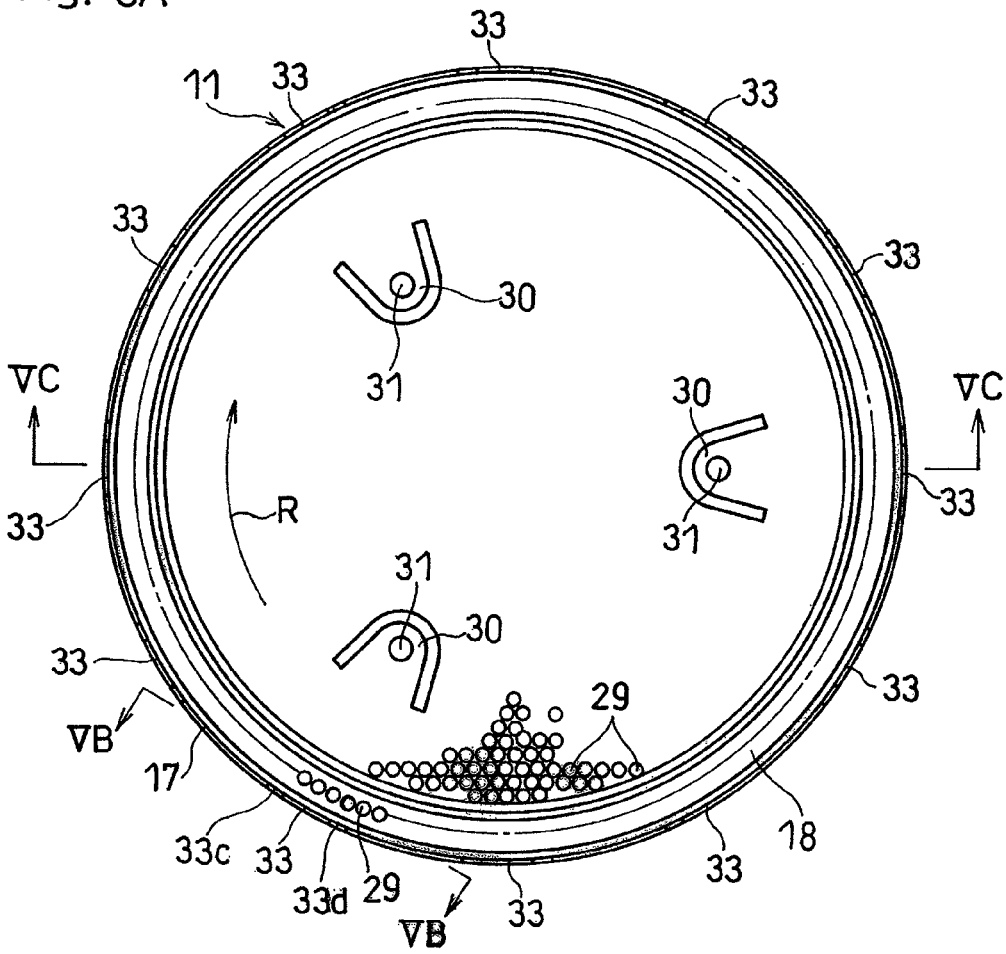
FIG. 5A is a top plan view of a screen member employed in the air-cooled engine.
Figure 5B:
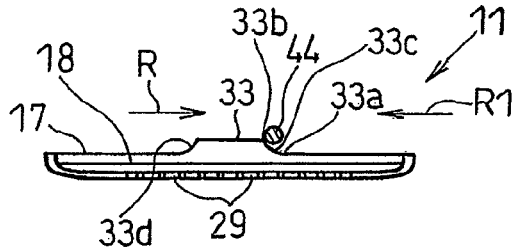
FIG. 5B is a cross-sectional view taken along the line VB-VB in FIG. 5A.
Figure 5C:
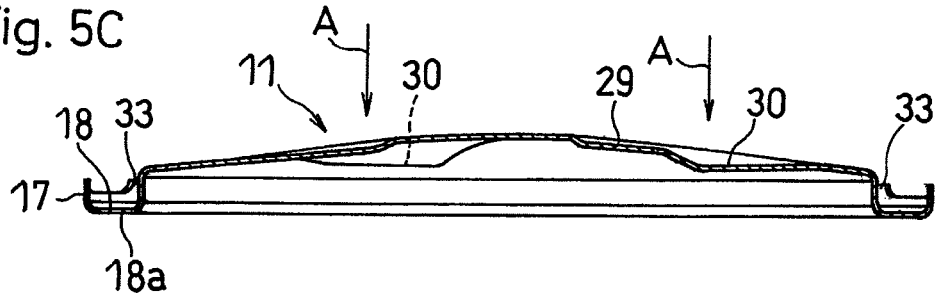
FIG. 5C is a cross-sectional view taken along the line VC-VC in FIG. 5A.

FIG. 5A is a schematic top plan view of the dust preventive screen member 11 employed in the air-cooled engine, and FIGS. 5B and 5C are cross-sectional views taken along the lines VB-VB and VC-VC in FIG. 5A, respectively. This screen member 11 is in the form of, for example, a thin metallic plate prepared by any known press work and, as best shown in FIG. 5C, a major portion of the screen member 11 excluding an outer peripheral portion thereof is recessed to protrude upwardly to represent a sectional configuration similar to a shallow bowl. This upwardly protruding major portion of the screen member 11 is perforated to have a multiplicity of vent holes 29. Respective portions of the upwardly protruding major portion of the screen member 11, where upper ends of the support posts 28 shown in FIG. 1 are connected, are formed with a flat connecting seat 30. The flat connecting seat 30 has a corresponding connecting hole 31 defined therein as best shown in FIG. 5A for connection with the associated support post 28.

As best shown in FIG. 5B, the cutter 17 provided in the outer peripheral portion of the screen member 11 is made up of a plurality of cutting blades 33 oriented in a direction close towards the fan casing 12 (shown in FIG. 1), that is, in a direction upwardly as viewed in FIG. 1. Each of the cutting blades 33 of the cutter 17 has leading and trailing edges 33*c* and 33*d* opposite to each other and defined respectively on leading and trailing sides with respect to the direction of rotation R.

Each of the leading edges 33*c* of the cutting blades 33 extends between a root portion 33*a* and a tip portion 33*b* and is gradually curved inwardly of the respective cutting blade 33. Each of the trailing side edges 33*d* of the cutting blades 33 also extending between the root portion 33*a* and the tip 33*b* is similarly gradually curved inwardly of the respective cutting blade 33. It is however to be noted that the leading and trailing side edges 33*c* and 33*d* may extend straight.

In the illustrated embodiment, the cutter 17 employs 12 cutting blades 33 and those cutting blades 33 each having the curved leading edge 33*c* are arranged substantially equidistantly spaced from each other in a direction circumferentially of the screen member 11. Some of the vent holes 29 referred to above are also formed in a bottom wall of the annular recess 18 positioned radially inwardly of the cutter 17 so that finely divided chips of turf and/or grass can be expelled through those vent holes 29 to the outside by the stream of cooling air A, thereby preventing the divided chips of turf and/or grass from being accumulated within the annular recess 18.

The flywheel 9, the cooling fan assembly 10 and the dust preventive screen member 11 are fixedly mounted on the crankshaft 1 in the manner which will now be described. At the outset, as shown in FIG. 1, the flywheel 9 is fixed by a bolt 24 to the upper end 1*b* of the crankshaft 1 through a key and groove engagement (not shown) for rotation together therewith. After the cooling fan assembly 10 has been subsequently placed on a predetermined area of an upper surface of the flywheel 9, an annular metallic retainer plate 27, shown by the double dotted lines in FIG. 3, is placed over the upper surface of the flywheel 9 and the annular base plate 20 of the cooling fan assembly 10 as shown in FIG. 1. The annular retainer plate 27 is, when being mounted on the flywheel 9, positioned by means of the knock pins 23 then engaged in respective four positioning grooves 27*a* defined in an outer peripheral edge of the retainer plate 27. At this time, because of the engagement of the knock pins 23 in the corresponding positioning grooves 27*a*, three insertion holes 27*b* defined in the annular retainer plate 27 shown by the double dotted line in FIG. 3 are aligned with respective screw holes 9*a* defined in the flywheel 9 shown in FIG. 1.

Starting from this condition, when a screw portion 28*a* defined in a lower base end of each of the support posts 28 shown in FIG. 1 is inserted through the corresponding insertion hole 27*b* in the annular retainer plate 27 and is then screwed into the associated screw hole 9*a* defined in the flywheel 9, the cooling fan assembly 10 is rigidly secured to the flywheel 9 in a condition sandwiched between the upper surface of the flywheel 9 and the annular retainer plate 27 fixed in position by the three support posts 28. The three support posts 28, after having been fixed to the flywheel 9 in the manner described above, protrude outwardly from the cooling fan assembly 10 in a direction conforming to the longitudinal axis C of the crankshaft 1.

After the connecting holes 31 defined in the flat connecting seats 30 in the screen member 11 are aligned respectively with screw holes 28*b* defined in upper ends of the support posts 28, bolts 32 are passed through the corresponding connecting holes 31, and then, screwed into the screw holes 28*b* in the support posts 28. With such fastening arrangement the screen member 11 is mounted fixedly on and fitted to the three support posts 28 so as to cover the upstream area above the cooling fan assembly 10 with respect to the direction of flow of the stream of cooling air A. In this condition, an outer bottom surface 18*a* of the annular recess 18 in the screen member 11 and upper edges of the rotary blades 21 of the cooling fan assembly 10 are either held in engagement with each other or spaced a slight distance from each other.

With the dust preventive structure so constructed as hereinabove described in accordance with the present invention, the air-cooled engine E shown in FIG. 1 is started by the electrically driven starter motor 39 and the flywheel 9, the cooling fan assembly 10 and the dust preventive screen member 10 rotate together with the crankshaft 1 The stream of air A induced by a suction force developed by the rotating cooling fan assembly 10 is then drawn into the main casing body 12*a* from the air flow slits 38 in the cover member 12*b* by way of the screen member 11 positioned in the air intake opening 14. This stream of cooling air A is further supplied through the cooling air flow path 13, defined within the main casing body 12*a*, to around the main engine body EB, including the cylinder blocks 3, the cylinder heads 7 and the crankcase 2, to cool the main engine body EB before it is finally discharged to the outside.

Dust particles such as, for example, chips of turf and/or grass entering into the air intake opening 14 through the air flow slits 38, defined in the cover member 12*b*, in admixture with the stream of cooling air A, are, after having been blocked by the screen member 11, forced to move towards the outer peripheral portion of the screen member 11 by the effect of the flow of the stream of cooling air A and a centrifugal force developed by the screen member 11 then rotating together with the crankshaft 1. Then, the particles are then expelled to the outside through some of the air flow slits 38 defined in the peripheral wall 12*ba* of the cover member 12*b*.

On the other hand, relatively long turfs and/or grasses remaining without being so expelled to the outside are further expelled radially outwardly by the stream of cooling air A and the centrifugal force, and finely cut by the cutter 17 as they pass through a gap between the cutter 17 and the fan casing 12 by way of the annular recess 18 and are then transported to the main engine body EB through the cooling air flow path 13 together with the stream of cooling air A. Accordingly, the turfs and/or grasses so cut finely by the cutter 17 will not clog in between the cooling fins 8 of the cylinder blocks 3 and the cylinder heads 8.

It is to be noted that the screen member 11 best shown in FIG. 1 has the major portion thereof held at a level higher than an imaginary plane 43, shown by the single dotted line, matching with lowermost portions of the air flow slits 38 defined in the outer peripheral wall 12*ba* of the cover member 12*b*, that is, in a level displaced in the axially outward direction Z1 that is parallel to the longitudinal axis of the crankshaft 1. Accordingly, turfs and/or grasses deposited on the upper surface of the screen member 11 can be readily expelled to the outside through the air flow slits 38 by the effect of the centrifugal force developed by the screen member 11 during the rotation of the latter.

It is however to be noted that the major portion or an entire portion of the screen member 11 may be held at a level lower than the imaginary plane 43 referred to above and, even in this case, the cutting operation accomplished by the cutter 17 in cooperation with the annular recess 18 does not alter. It is also to be noted that the cutter 17 may not be formed with the cutting blades 33 such as shown in FIG. 5B and may have its round upright tip shaped to a round knife edge with no indentation.

Figure 6:
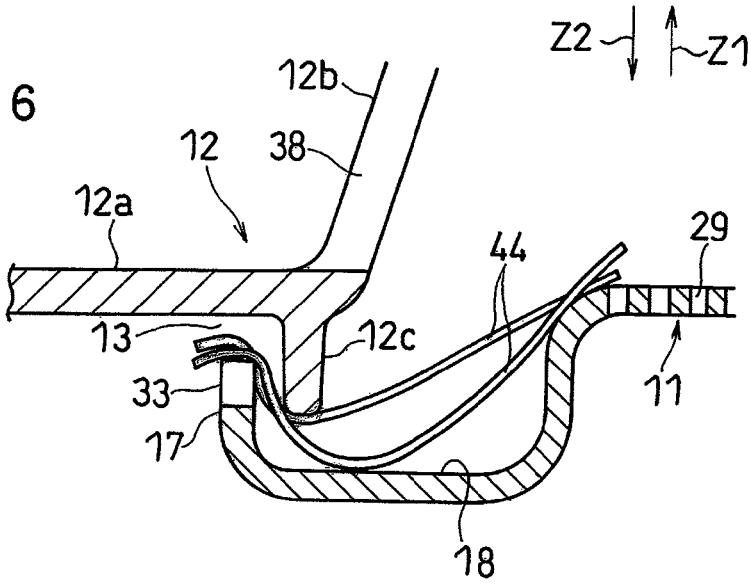
FIG. 6 is a fragmentary sectional view on an enlarged scale, showing the manner in which relatively long turf or grass is cut.

More specifically, referring now to FIG. 6, the relatively long turfs and/or grasses 44, when entering the annular recess 18 and brought into contact with the annular lug 12*c* of the fan casing 12, are diverted to move in the axial direction Z2 away from the fan casing 12 and parallel to the longitudinal axis of the crankshaft 1. Then, the turfs and/or grasses 44 are, after diverted to move in the axial direction Z1 opposite to Z2, guided towards the gap between the cutter 17 and the fan casing 12, and cut by the cutting blades 33 of the rotating cutter 17. At this time, the relatively long turfs and/or grasses 44 are engaged with the annular lug 12*c* and are cut by the cutting blades 33 of the cutter 17 in a condition in which the movement of the turfs and/or grasses 44 in a radial outward direction is almost blocked. Accordingly, rough cutting of the turfs and/or grasses, which would otherwise occur when the cutter 17 cuts the turfs and/or grasses passing thereacross at a high speed, can be effectively suppressed to allow them to be finely cut.

In addition, since each of the plural cutting blades 33 of the cutter 17, which are intermittently arranged in the circumferential direction of the cutter 17, is formed with the leading edge 33*c* extending from the root portion 33*a* to the tip 33*b* so as to be gradually curved inwardly of the respective cutting blade 33, the following effects can be obtained.

Specifically, during the rotation of the cutter 17, cutting forces of the cutting blades 33 are gradually applied to the turfs and/or grasses 44 progressively from the root portion 33*a* to the tip 33*b* of the leading edges 33*c* and, accordingly, they can be cut smoothly and assuredly. Also, since the tip 33*b* is inclined relative to a direction perpendicular to the circumferential direction of the cutter 17, no cutting load acts instantly on the cutting blades 33 thereby to increase the durability of the cutting blades 33.

Figure 12:
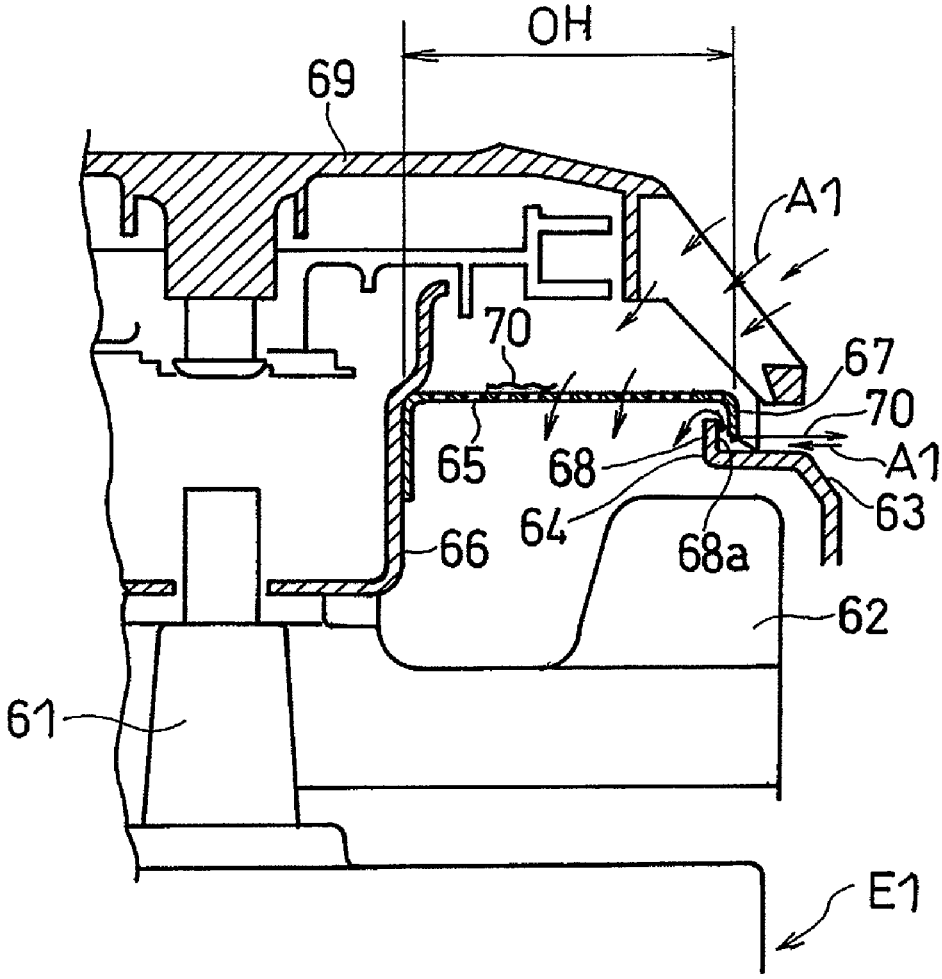
Fig. 12 PRIOR ART
FIG. 12 is a fragmentary longitudinal sectional view showing a relevant portion of the prior art air-cooled engine.

In the embodiment described hereinabove, the screen member 11 including the cutter 17 at the outer peripheral portion thereof as shown in FIG. 1 is accommodated in its entirety within the fan casing 12 and is not so shaped as to extend to the outer peripheral surface 68*a* of the flange 68 defining an outer edge of the air intake opening 64 shown in FIG. 12. Accordingly, a considerably large overhang OH does not occur in a radial direction of the screen member 11 shown in FIG. 1. In other words, the radial overhang OH is limited to an area from any one of the support posts 28 to the cutter 17.

In addition, since the annular recess 18 in the outer peripheral portion of the screen member 11 is opposed to the rotary blades 21 and either held in engagement with the rotary blades 21 of the cooling fan assembly 10 or spaced a slight distance therefrom, an undesirable deformation of the annular recess 18 in the axially inward direction (in a downward direction) can be suppressed advantageously. In view of this, no overhang of the screen member 11 occur almost and, therefore, there is no need to use any complicated support structure to suppress an undesirable deformation of the screen member 11, allowing the freedom of design to be enhanced. Also, since the screen member 11 is supported only by the three slender support posts 28, the flow resistance to the stream of cooling air A flowing within and across the cooling fan assembly 10 can be minimized to allow a sufficient amount of the cooling air A to be sucked.

Figure 7A:
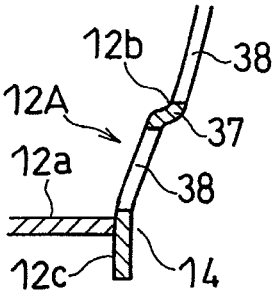
FIGS. 7A and 7B are fragmentary sectional views, showing different examples of a fan casing employed in the air-cooled engine, respectively.

In the foregoing embodiment, the fan casing 12 has been shown and described as formed integrally the cover member 12*b* and the annular lug 12*c* with the main casing body 12*a* by means of any known resin molding technique, but as shown in FIG. 7A, the cover member 12*b* and the annular lug 12*c* may be a member separate from the main casing body 12*a*. Specifically, the fan casing shown in FIG. 7A and now identified by 12A is so designed and so structured that the main casing body 12*a* and the cover member 12*b* are separately prepared by means of any known resin molding technique and the cover member 12*b* is bonded to the main casing body 12*a*. Such bonding is effected with a portion of the cover member 12*b* adjacent a lower end thereof engaged in an upper opening of the main casing body 12*a*, defining the air intake opening 14, by the use of any known bonding means such as, for example, a high frequency welding method or a heat bonding method. The annular lug 12*c* is in this case formed in a portion of the cover member 12*b* below the joint between the cover member 12*b* and the main casing body 12*a*.

Figure 7B:
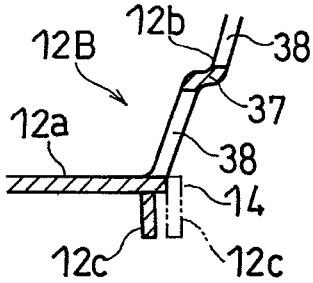

Alternatively, as shown in FIG. 7B, the fan casing now identified by 12B may be so designed and so structured that after the main casing body 12*a* and the cover member 12*b* have been formed integrally with each other by means of any known resin molding technique and, on the other hand, the annular lug 12*c* separate from the main casing body 12*a* and the cover member 12*b* has been prepared by any known molding technique, the annular lug 12*c* is bonded to the inner surface of the main casing body 12*a* adjacent to the air intake opening 14 by the use of any known bonding means such as, for example, a high frequency welding method or a heat bonding method. Again alternatively, as shown by double dotted line in FIG. 7B, the annular lug 12*c* may be engaged with an inner peripheral edge of the air intake opening 14 of the main casing body 12*a* and bonded thereto.

Hereinafter, the air-cooled engine according to a second preferred embodiment of the present invention will be described with particular reference to FIG. 8, which shows a fragmentary longitudinal sectional view of the air-cooled engine according to the second preferred embodiment, showing the fan casing and the screen member.

Figure 8:
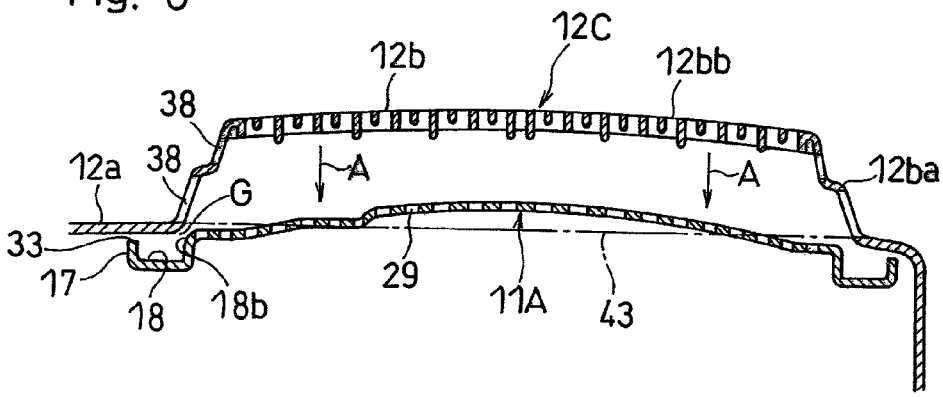
FIG. 8 is a fragmentary longitudinal sectional view showing a portion of the air-cooled engine according to a second preferred embodiment of the present invention.

The fan casing and the screen member, employed in the air-cooled engine shown in FIG. 8 are identified by 12C and 11A, respectively. It is, however, to be noted that the fan casing 12C shown in FIG. 8 is substantially similar to the fan casing 12 employed in the previously described embodiment, except for the use of the annular lug 12*c* (shown in FIG. 1) excluded from the fan casing 12C. On the other hand, the screen member 11A shown in FIG. 8 has a diameter somewhat greater than that of the screen member 11 employed in the previously described embodiment.

This screen member 11A is arranged relative to the fan casing 12C in face-to-face relation with a slight gap G left between an open end inner peripheral edge 18*b* of the annular recess 18 and a joint of the main casing body 12*a* to the cover member 12*b*.

According to the second embodiment shown in and described with reference to FIG. 8, although the fan casing 12C has no annular lug such as the annular lug 12*c* best shown in FIG. 1, the relatively long turfs and/or grasses transported to the outer peripheral portion of the screen member 11A by the effect of the centrifugal force and the stream of cooling air A will not immediately enter the annular recess 18 because the gap G between the open end inner peripheral edge 18*b* of the annular recess 18 and the cover member 12*b* is small. Instead, the relatively long turfs and/or grasses reaching the outer peripheral portion of the screen member 11A are brought into contact with the cover member 12*b* and the screen member 11A and are therefore decelerated in speed before they enter the annular recess 18 through the gap G. The turfs and/or grasses then entering the annular recess 18 are deflected upwardly within the annular recess 18 and are subsequently guided in between the cutter 17 and the main casing body 12*a*. At this time, the relatively long turfs and/or grasses are cut by the cutting blades 33 of the cutter 17 while they are engaged in the gap G and the annular recess 18, and, accordingly, they can be effectively cut in a manner similar to that afforded by the dust preventive structure employing the annular lug 12*c* as shown in FIG. 1.

Figure 9:
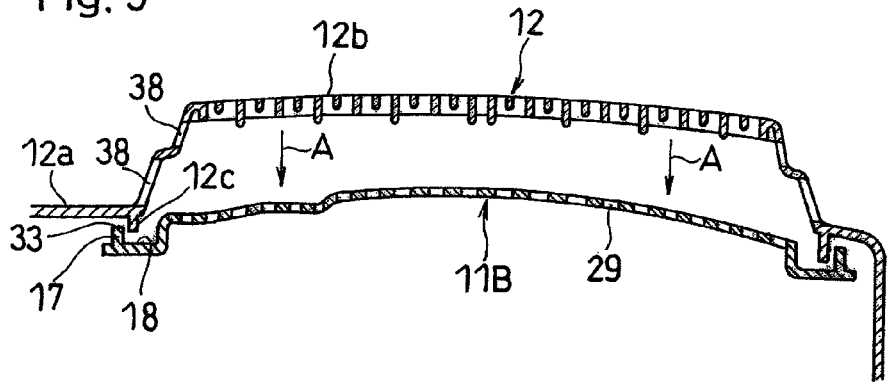
FIG. 9 is a fragmentary longitudinal sectional view showing a portion of the air-cooled engine according to a third preferred embodiment of the present invention.

The air-cooled engine according to a third preferred embodiment of the present invention is shown in FIG. 9, which shows a view similar to that in FIG. 8. This third embodiment differs from the previously described first embodiment in respect of the screen member.

The screen member employed in the practice of the third embodiment is identified by 11B in FIG. 9. In this screen member 11B, the cutter 17 is formed at a portion of the screen member 11B with a slight distance radially inwardly from the outer peripheral portion thereof so as to extend upright in an axially outward direction, not formed in the outer peripheral portion of the screen member 11 such as in the first embodiment. Even with this third embodiment, effects similar to those described in connection with the first embodiment can be equally obtained.

Figure 10:
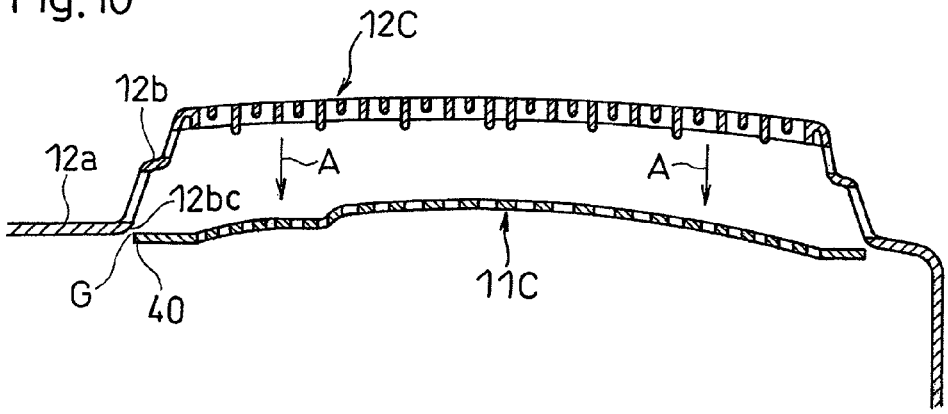
FIG. 10 is a fragmentary longitudinal sectional view showing a portion of the air-cooled engine according to a fourth preferred embodiment of the present invention.
Figure 11:
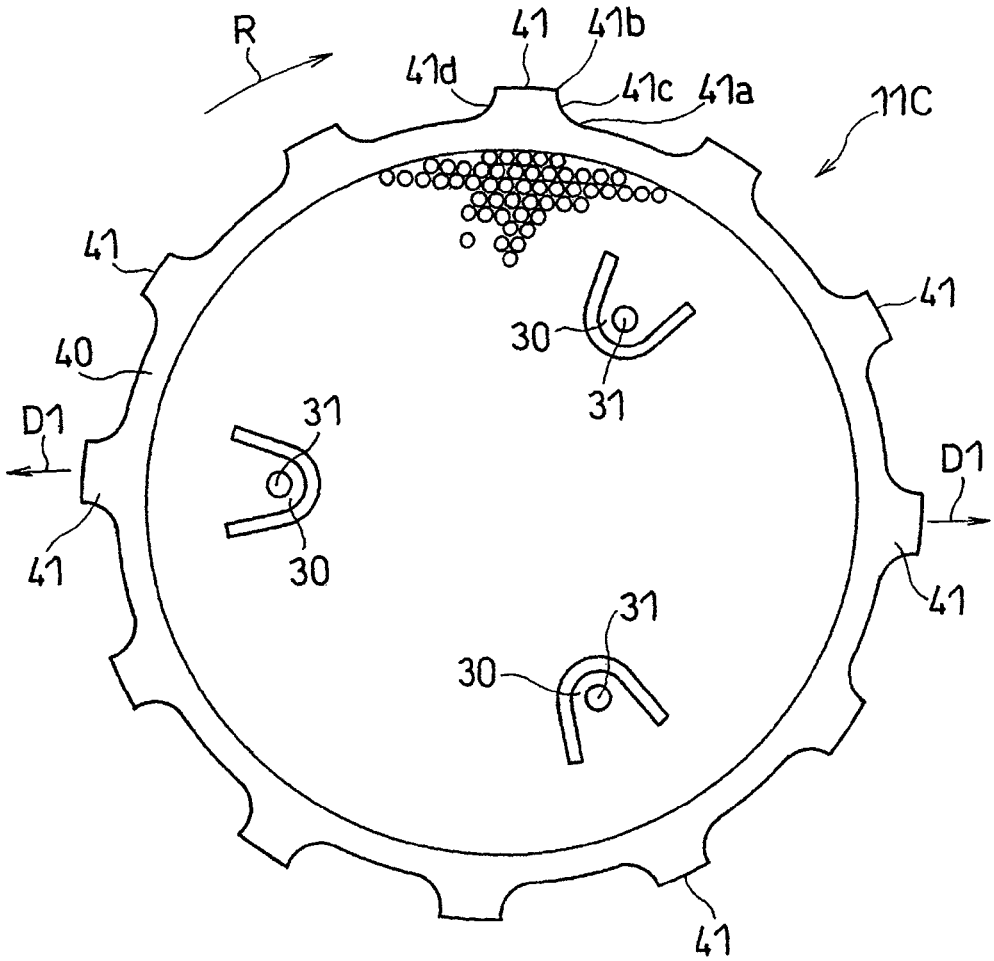
FIG. 11 is a top plan view of the screen member shown in FIG. 10.

The fan casing and the screen member employed in the air-cooled engine according to a fourth preferred embodiment of the present invention are shown in FIGS. 10 and 11 in fragmentary longitudinal and top plan representations, respectively. The fan casing and the screen member shown in FIG. 10 are identified by 12C and 11C, respectively.

Referring particularly to FIG. 10, the fan casing 12C shown therein is substantially similar to that employed in the practice of the first embodiment, except that only the annular lug 12*c* best shown in FIG. 1 is dispensed with. In this sense, the fan casing 12C is similar in shape to that employed in the practice of the second embodiment shown in and described with particular reference to FIG. 8. On the other hand, the screen member 11C is substantially similar to the screen member 11 employed in the first embodiment, but no annular recess such as the annular recess 18 best shown in FIG. 1 is dispensed with and, instead, a cutter 40 is formed in the outer peripheral portion of the screen member 11C, which is disc-shaped and somewhat curved, so as to extend in a direction D1 radially outwardly therefrom as shown in FIG. 11.

The cutter 40 includes a plurality of substantially circumferentially equidistantly spaced cutting blades 41 and each of the cutting blades 41 has leading and trailing edges 41*c* and 41*d* opposite to each other and defined respectively on leading and trailing sides with respect to the direction of rotation R in a manner substantially similar to the cutting blades 33 in the first embodiment. Specifically, in the embodiment shown in FIG. 10, each of the leading edges 41*c* extends between a root portion 41*a* and a tip 41*b* and is gradually curved inwardly of the respective cutting blade 41. Each of the trailing edges 41*d* of the cutting blades 33 also extending between the root portion 41*a* and the tip 41*b* is similarly gradually curved inwardly of the respective cutting blade 41. It is however to be noted that the leading and trailing side edges 41*c* and 41*d* may extend straight.

The screen member 11C is arranged relative to the fan casing 12C in face-to-face relation with a slight gap G left between the cutter 40 at the outer periphery thereof and a boundary portion 12*bc* which defines a boundary between the main casing body 12*a* of the fan casing 12C and the cover member 12*b*.

According to the fourth embodiment shown in and described with particular reference to FIGS. 10 and 11, the fan casing 12C does not have any annular lug such as the annular lug 12*c* shown in FIG. 1 and employed in the first embodiment and, similarly, the screen member 11C does not have any annular recess such as the annular recess 18 shown in FIG. 1 and employed in the first embodiment. However, the relatively long turfs and/grasses transported to the outer periphery of the screen member 11C by the effect of the stream of cooling air A and the centrifugal force are, after having collided against the joint 12*bc*, temporarily held standstill and are then deflected to move downwardly so as to be guided towards the gap G between the fan casing 12*c* and the cutter 40. However, since the gap G is very small, they do not pass through the gap G immediately and are decelerated in speed before they pass completely through the gap G. During the passage of the turfs and/or grasses through the gap C, they can be cut by the cutting blade 41 of the cutter 40 shown in FIG. 11 and, accordingly, effects similar to those afforded by the first embodiment can be equally obtained.

In the fourth embodiment as well as the first embodiment above described, the cutter 40 may not be formed with the cutter blade 41 such as shown in FIG. 11 and may have its round upright tip shaped to a round knife edge or a serration. According to this feature, the turfs and/or grasses can be cut by the cutter 40 rotating together with the screen member 11*c*. Also, in the respective embodiments described above, the fan casing 12, 12A, 12B or 12C may be made of metal such as a metal plate.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, the present invention although having been shown and described as applied to the air-cooled engine of the vertical type, in which the rotary drive shaft, i.e., the crankshaft 1 extends vertically, can be equally applied to the air-cooled engine of a transverse type in which the rotary drive shaft extends generally horizontally. Also, the present invention can be applied not only to the brush cutting machine referred to in the foregoing description of the preferred embodiments, but also to any agricultural implement and machinery such as, for example, a combine.

Accordingly, such changes and modifications are, unless they depart from the scope of the present invention as delivered from the claims annexed hereto, to be construed as included therein.

What is claimed is:

1. An air-cooled engine comprising:

a rotary drive shaft;

a flywheel mounted on the rotary drive shaft;

a cooling fan assembly provided on the flywheel and drivingly coupled with the rotary drive shaft for inducing a stream of cooling air;

a screen member fitted to the flywheel so as to cover an axial end face of the cooling fan assembly on a suction side and rotable with the cooling fan assembly;

a fan casing covering the cooling fan assembly and defining a path of flow of the stream of cooling air, the fan casing having an air intake opening defined therein for introducing the stream of cooling air to the cooling fan assembly and the screen member; and a cutter formed in the screen member at one of an outer peripheral portion of the screen member and a location operatively adjacent the outer peripheral portion of the screen member so as to protrude axially close to an inner surface of the fan casing at a position downstream of the cooling air from the air intake opening to enable a cutting operation by the cutter.

2. The air-cooled engine as claimed in claim 1, wherein the screen member has an annular recess defined in a portion of the screen member radially inwardly of the cutter so as to be recessed in a direction away from the fan casing.

3. The air-cooled engine as claimed in claim 1, wherein the fan casing is formed with an annular lug protruding in a direction away from the fan casing and towards a portion of the screen member radially inwardly of the cutter.

4. The air-cooled engine as claimed in claim 1, wherein the cutter includes a plurality of cutting blades arranged in a direction circumferentially of the screen member and protruding in a direction close to the fan casing.

5. The air-cooled engine as claimed in claim 4, wherein each of the cutting blades has a leading edge, with respect to a direction of rotation of the cutter, extending from a root portion to a tip in an axially outward direction and gradually curved rearwardly with respect to the direction of rotation.

6. The air-cooled engine as claimed in claim 1, wherein the fan casing includes a cover member for covering the air intake opening and allowing the stream of cooling air to pass therethrough.

7. The air-cooled engine as claimed in claim 1, wherein the screen member is fitted to a plurality of support posts protruding from the flywheel in an axial direction.

8. An air-cooled engine comprising:

a rotary drive shaft;

a flywheel mounted on the rotary drive shaft for rotation;

a cooling fan assembly provided on the flywheel and drivingly coupled with the rotary drive shaft for inducing a stream of cooling air;

a screen member fitted to the flywheel so as to cover an axial end face of the cooling fan assembly on a suction side and rotatable with the cooling fan assembly;

a fan casing covering the cooling fan assembly and defining a path of flow of the stream of cooling air, the fan casing having an air intake opening defined therein for introducing the stream of cooling air to the cooling fan assembly and the screen member; and a cutter formed in an outer peripheral portion of the screen member so as to protrude radially outwardly close to an inner surface of the fan casing at a position downstream of the cooling air from the air intake opening.

9. The air-cooled engine as claimed in claim 8, wherein the fan casing includes a cover member for covering the air intake opening and allowing the stream of cooling air to pass therethrough.

10. The air-cooled engine as claimed in claim 8, wherein the screen member is fitted to a plurality of support posts protruding from the cooling fan assembly in an axial direction.

11. The air-cooled engine as claimed in claim 8, wherein the screen member is in the form of a metallic plate.

12. The air-cooled engine as claimed in claim 8, wherein the screen member is positioned above the cooling fan assembly.

13. The air-cooled engine as claimed in claim 1, wherein the screen member is in the form of a metallic plate.

14. The air-cooled engine as claimed in claim 1, wherein the screen member is positioned above the cooling fan assembly.

* * * * *